US006843034B2

(12) United States Patent
McDonald

(10) Patent No.: US 6,843,034 B2
(45) Date of Patent: Jan. 18, 2005

(54) MASONRY BLOCK LOCKING DEVICE

(76) Inventor: Barry L. McDonald, 5105 Chowchilla Mountain Rd., Mariposa, CA (US) 95338

( * ) Notice: Subject to any disclaimer, the term of this patent is extended or adjusted under 35 U.S.C. 154(b) by 0 days.

(21) Appl. No.: 10/159,867

(22) Filed: May 31, 2002

(65) Prior Publication Data

US 2003/0221386 A1 Dec. 4, 2003

(51) Int. Cl.[7] ..... E04B 1/02; E04C 3/30

(52) U.S. Cl. ..... 52/564; 52/596; 52/568; 52/712; 248/205.1; 24/570; 24/571

(58) Field of Search ..... 52/564, 205.1, 52/584, 712, 596, 568; 403/206, 209, 213, 211, 293, 286, 409; 24/570, 571

(56) References Cited

U.S. PATENT DOCUMENTS 1,894,121 A * 1/1933 Pronnecke ..... 24/570
2,543,716 A 2/1951 Carini
4,237,670 A * 12/1980 De Waele ..... 52/438
4,408,398 A 10/1983 Glaze
4,802,318 A * 2/1989 Snitovski ..... 52/309.12
5,056,289 A 10/1991 Colen
5,231,815 A 8/1993 Colen
5,351,457 A * 10/1994 Colen ..... 52/564
D354,527 S 1/1995 Ryan et al.
5,481,812 A 1/1996 Pedano
5,649,391 A * 7/1997 Layne ..... 52/36.4
5,829,217 A 11/1998 Colen
6,082,067 A * 7/2000 Bott ..... 52/592.3

* cited by examiner

*Primary Examiner*—Carl D. Friedman
*Assistant Examiner*—Nahid Amiri
(74) *Attorney, Agent, or Firm*—Mark D. Miller

(57) ABSTRACT

A method and apparatus for constructing masonry walls made of open-celled blocks without the need for mortar between individual blocks or courses of blocks using individual C-shaped bracketed pieces that lock adjacent blocks together. The open-celled blocks must have recessed notches between the cells to receive the brackets. An alternative E-shaped bracket structure allows for defined spacing between blocks that may be used to create curves in the wall.

25 Claims, 6 Drawing Sheets

MASONRY BLOCK LOCKING DEVICE

BACKGROUND OF THE INVENTION

1. Field of the Invention

The present invention relates to block wall construction, and more particularly to a method and apparatus for use in the construction of cinder and/or cement masonry block walls.

2. Description of the Prior Art

Cinder, cement, clay and other masonry blocks and bricks are popular in the construction of walls because of their relatively low cost and consistent appearance. However, present techniques for the construction of block walls are cumbersome, labor intensive and suffer from drawbacks because special ("buttered") mortar is required to be applied between the individual blocks and between the rows or courses of blocks in the wall. It is a time consuming and messy task to mix a batch of the mortar, and to thereafter constantly shuttle back and forth between the block wall and the mortar supply to apply the necessary mortar between each individual block, and between each course of blocks. Additional batches of mortar must often be mixed during the course of block wall construction, particularly with larger walls. Then, when construction is complete, the messy mortar must be cleaned up.

In addition to the labor and cleanup problems associated with applying mortar, any excess mortar that is applied between the individual blocks or courses of blocks in the wall has a tendency to squeeze into the openings or cells inside the blocks. When the mortar hardens, it leaves irregular shapes and blobs of excess material inside the cells. This can be detrimental to structural strength since such excess mortar can displace the structural grout that is ordinarily poured into these cells after the wall is erected, and may even prevent such grout from entering into the cells.

Obtaining consistent spacing between the individual blocks in the wall as well as between the courses of blocks also poses a perennial problem in construction. Different spacing devices have been developed in the prior art for use in the construction of block walls, including the spacer of U.S. Pat. No. 5,231,815 which discloses a support unit having various flanges, legs and tabs, the support unit being designed for placement between blocks to separate them by a constant distance. Mortar is then applied over and around these spacer units which become part of the wall. However, the spacer of the '815 patent is of complicated design, and it does not eliminate the need for mortar to be applied between the blocks and courses of blocks, and the above-described problems associated therewith.

It is therefore desirable to reduce or eliminate the mortar ordinarily used in the construction of block walls while maintaining appropriate wall strength. It is also desirable to provide a way to establish consistent spacing between blocks and courses of blocks in a block wall using a minimum amount of mortar.

SUMMARY OF THE INVENTION

The present invention provides a method and apparatus for constructing block walls without the need for mortar between individual blocks or courses of blocks by providing individual bracketed pieces that are used to lock adjacent blocks together. The locking pieces of the present invention are designed for use with blocks of the type having openings or cells inside the individual blocks, with recessed notches between the cells. The blocks may be made of any appropriate masonry material such as cinder, clay, cement or brick.

The locking pieces of the present invention are designed for permanent installation in a block wall to hold adjacent blocks together along a horizontal course or tier of blocks. The locking pieces are preferably made of metal, although any rigid material such as plastic may be used. The adjacent blocks to be attached together may be end-to-end along a course; or they may be perpendicular to each other, such as at a corner. Each locking piece has a generally flat cross section, and includes a cross member having a pair of integral arms attached at both ends. The arms are generally parallel to each other and perpendicular to the cross member, and define a space between them. The arms of each locking piece are designed for generally vertical insertion into the cell spaces of pairs of adjacent wall blocks in a horizontal course or tier of blocks, such that the cross member of each locking piece extends horizontally between the adjacent blocks through their respective recessed notches. Because the cross member fits into the recessed notches of the subject blocks, it does not extend upward and therefore has no effect on or interference with any course of blocks that may be installed on top of the subject blocks in the present course. Installing the locking pieces between every block in the course holds the entire course together. Although it is preferred that two locking pieces be used between each pair of adjacent blocks, a single locking piece may be used. Vertical steel rods are provided at different locations in the block wall to provide vertical stability, and to help properly orient the multiple courses of blocks of the wall in proper spaced relationship to each other. Reinforcing grout is then poured into the open cells of the blocks after the wall is erected.

An alternative form of the present invention includes an additional centrally located arm that is used to create a space between adjacent horizontal blocks of a course. The alternative locking pieces may be used in conjunction with the standard locking pieces to create curved or arcuate walls. To establish a concave curve in the wall, the standard locking pieces (C-shaped) are installed across the notches between adjacent blocks near the fronts of the blocks, and the modified locking pieces (E-shaped) are installed across these same notches near the rears of the blocks such that the additional vertical arm of the E-shaped piece extends between the blocks at the rear. This spaces the rear edges of the blocks apart while compressing the front edges together. The result is a concave or curved wall. Similarly, a wall having a convex curve may be established by installing the modified locking pieces (E-shaped) across the notches between adjacent blocks near the fronts of the blocks, and installing the standard locking pieces (C-shaped) across these same notches near the rears of the blocks. In this way, the additional vertical arms of the E-shaped pieces extend between the blocks at the front, creating a convex curve in the wall.

The degree of the angle between adjacent blocks is determined by the width of the additional central arm of the modified locking piece. A wider central arm will result in a greater angle between blocks, and a more pronounced curve in the wall; a narrower vertical arm will result in a lesser angle between blocks, and a gentler curve in the wall. Modified pieces having central arms of different widths may also be used to provide different angles between adjacent blocks in the same course, or in different courses, for different aesthetic appearances or combinations of curves in the wall.

It is therefore a primary object of the present invention to provide an apparatus for securely attaching adjacent open-celled masonry blocks of a course together in the construction of walls without the need for mortar.

It is also a primary object of the present invention to provide an efficient method for quickly and securely attaching adjacent open-celled masonry blocks of each course together during the construction of a wall without the steps of mixing or applying mortar.

It is also an important object of the present invention to reduce labor time and to avoid unnecessary material costs in the construction of walls using open-celled masonry blocks by eliminating the need for preparation, application and drying of mortar between blocks and between courses during construction.

It is another object of the present invention to provide a method and apparatus for securely attaching adjacent open-celled blocks of a course together at defined angles in the construction of a masonry wall in order to impart curve(s) to the wall.

It is a further object of the present invention to provide a method and apparatus for constructing stronger and more durable walls using open-celled masonry blocks that eliminates the use of mortar thereby eliminating the chance for clogs in the cells of the blocks that could prevent the reinforcing structural grout from filling them in.

It is a further object of the present invention to provide a generally C-shaped bracket with a longitudinal base having a pair of arms that are generally parallel to each other and perpendicular to the base in which the arms are inserted into the end cells of adjacent open-celled masonry blocks for securely holding the adjacent blocks together.

It is a further object of the present invention to provide a generally E-shaped bracket having a longitudinal base with three arms that are generally parallel to each other and perpendicular to the base in which the end arms are inserted into the end cells of adjacent open-celled masonry blocks for securely holding the adjacent blocks together, and the center arm is extended between the blocks defining a space therebetween.

Additional objects of the invention will be apparent from the detailed descriptions and the claims herein.

DETAILED DESCRIPTION OF A PREFERRED EMBODIMENT

Figure 1:
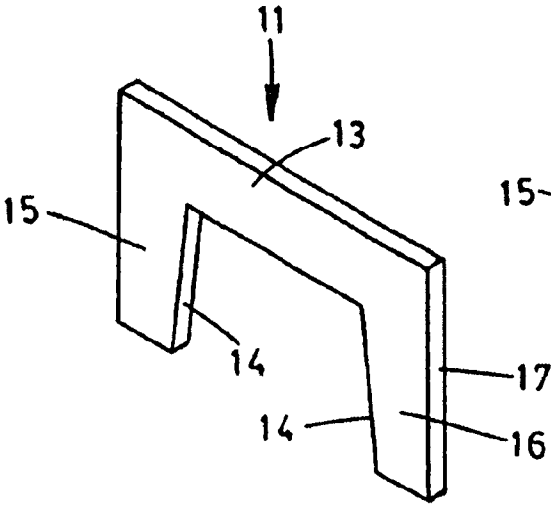
FIG. 1 is a perspective view of a first embodiment of the present invention.
Figure 2:
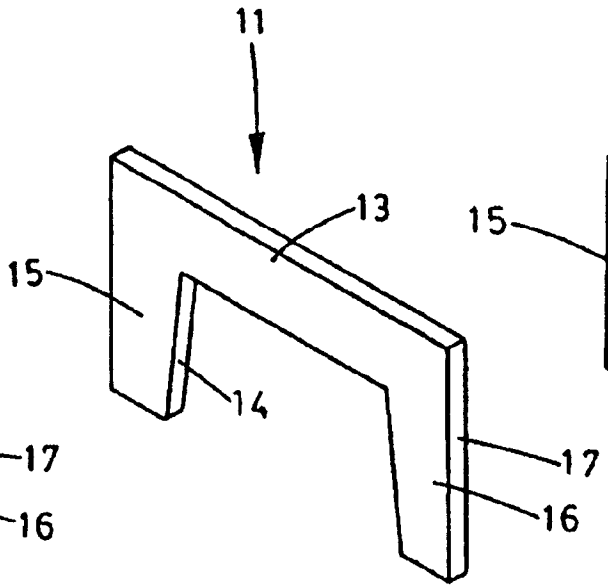
FIG. 2 is a perspective view of a second embodiment of the present invention.

Referring to the drawings wherein like reference characters designate like or corresponding parts throughout the several views, and referring particularly to FIGS. 1–4, it is seen that one aspect of the present invention is in the form of a C-shaped bracket 11 having a generally flat cross section made up of a longitudinal cross member 13 and a pair of integral arms 15, 16 located at each end of cross member 13. Arms 15 and 16 are generally parallel to each other and generally perpendicular to cross member 13. The outside edges 17 of arms 15 and 16 are at approximately right angles to cross member 13, however the inside edges 14 are slightly tapered such that the outwardly extending distal ends of arms 15 and 16 are more narrow than the proximal ends which are integrally attached to the cross member. This tapering allows for more frictional contact between the inside edges 14 of arms 15 and 16 and the edges of the masonry blocks 21 into which the arms are inserted.

Figure 4:
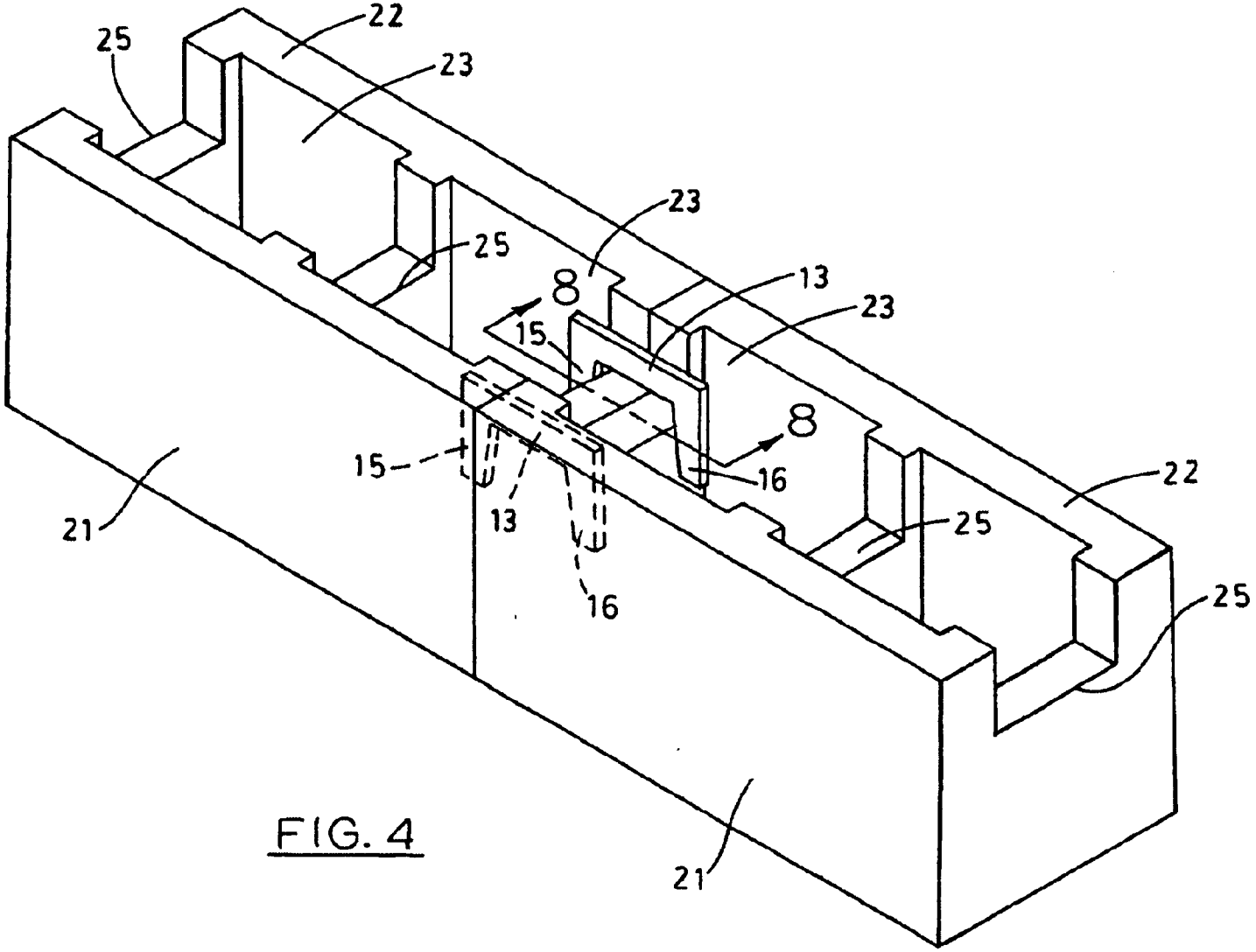
FIG. 4 is a perspective view of a pair of side-by-side open-celled masonry blocks being held together using the brackets of the present invention.
Figure 8:
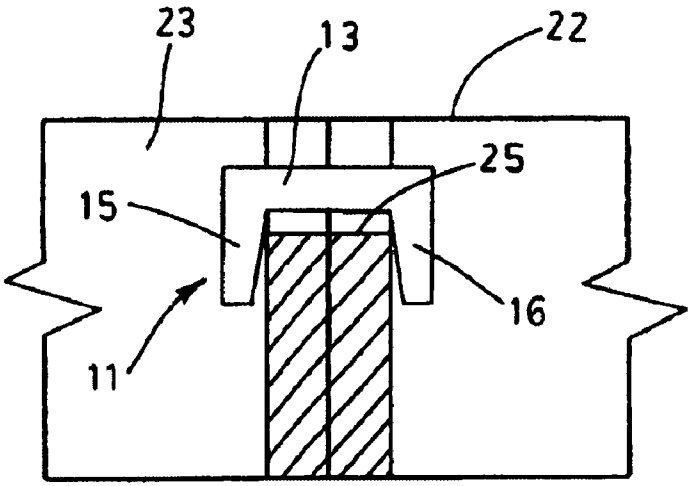
FIG. 8 is a sectional view along line 8—8 of FIG. 4.

Referring to FIG. 4, it is seen that the C-shaped brackets of the present invention are used to hold adjacent masonry blocks 21 together. Each masonry block 21 includes at least one internal open cell 23 with a large recessed notch 25 at an outside edge of the block. Blocks 21 are placed next to each other in touching relationship as shown in FIG. 4, with the recessed notches 25 of each block defining a gap or passageway along line 8—8 between the end cells 23 of the adjacent blocks 21. Then at least one, but preferably two, of the C-shaped brackets 11 of the present invention are inserted across the gap 8—8 between the cells. A hammer or other suitable tool is used to force the brackets 11 into gap 8—8 such that the tapered inside surfaces 14 of arms 15 and 16 are frictionally engaged with the walls below notches 25 of each of the adjacent blocks 21, thereby holding the blocks firmly against each other. Brackets 11 are forced a sufficient distance into gaps 8—8 such that the top of cross member 13 is below the upper surface 22 of the blocks in the course, as shown in the cross sectional view of FIG. 8.

Figure 5:
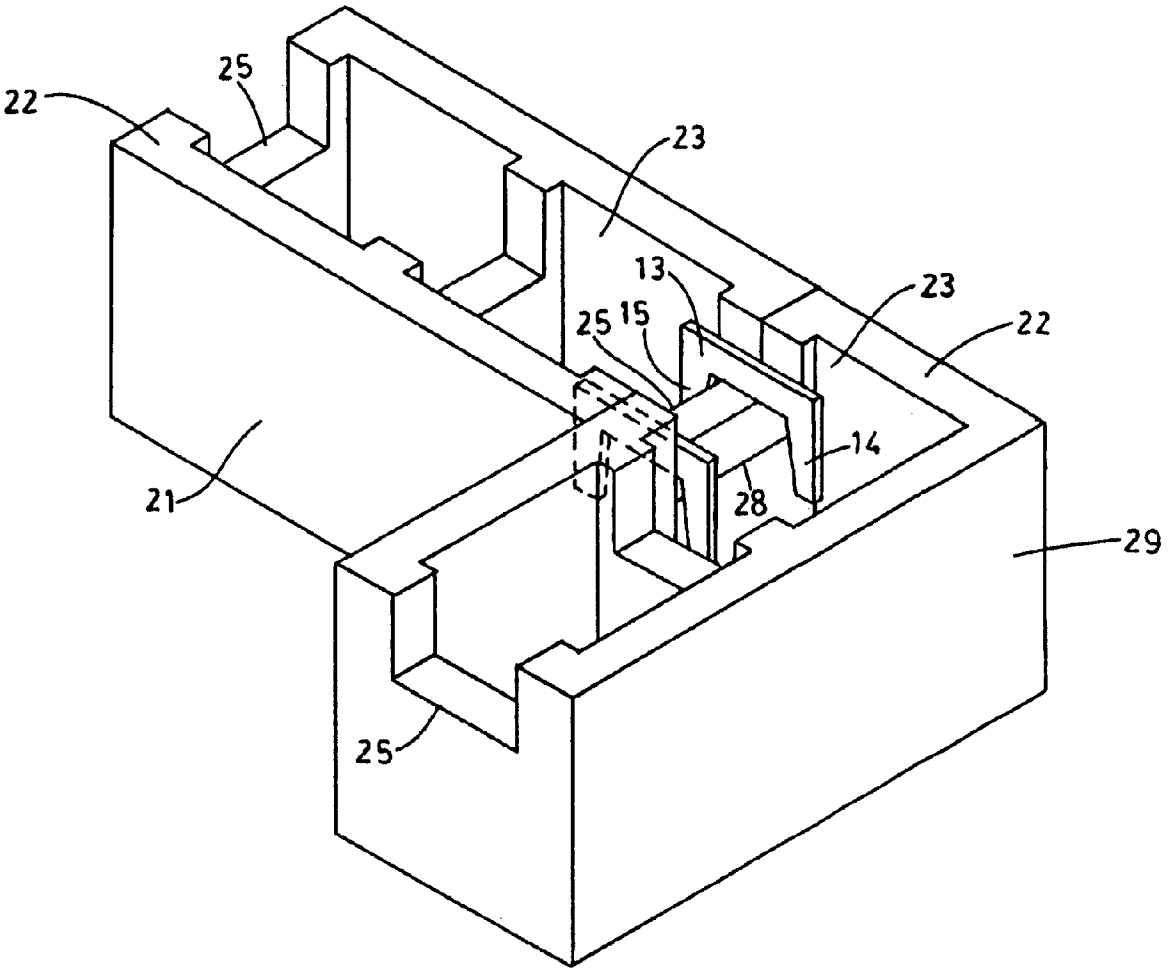
FIG. 5 is a perspective view of a pair of open-celled masonry blocks forming a corner where the blocks are held together using the brackets of the present invention.

FIG. 5 illustrates attachment of masonry blocks 21 at a corner, where notch 25 is provided at the end of block 21, and a corresponding notch 28 is provided on the side of a corner block 29. Bracket 11 is inserted through the gap created by notches 25 and 28 to hold blocks 21 and 29 together.

Figure 3:
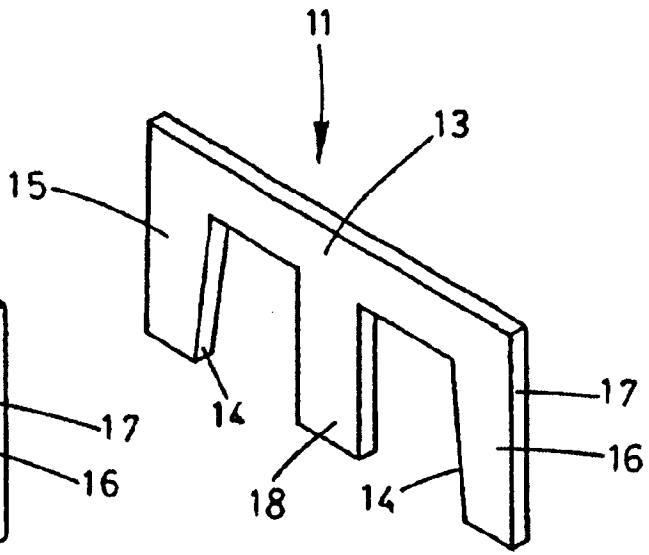
FIG. 3 is a perspective view of a third embodiment of the present invention.
Figure 6:
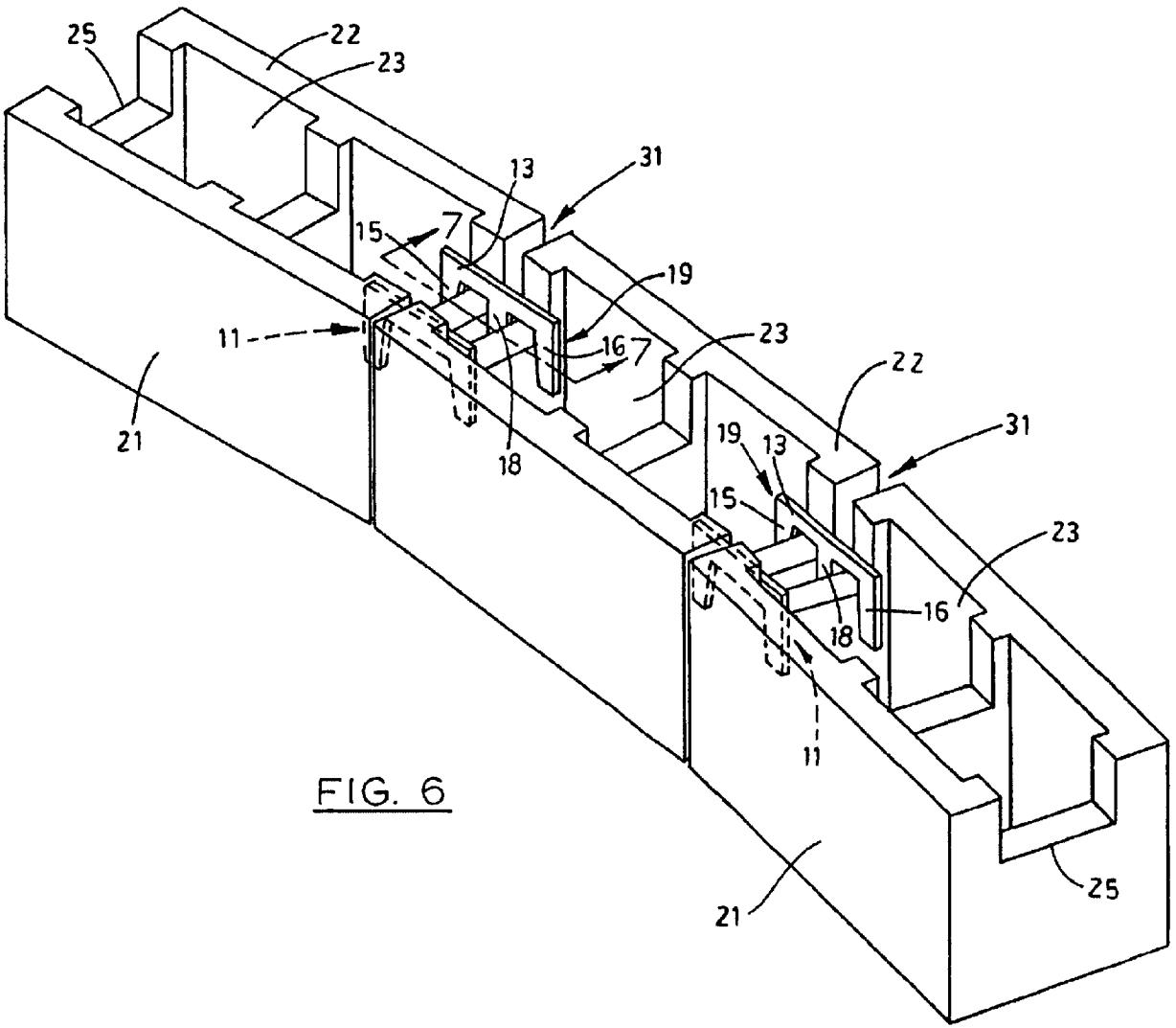
FIG. 6 is a perspective view of three side-by-side open-celled masonry blocks being held together at an angle using the brackets of the present invention.
Figure 7:
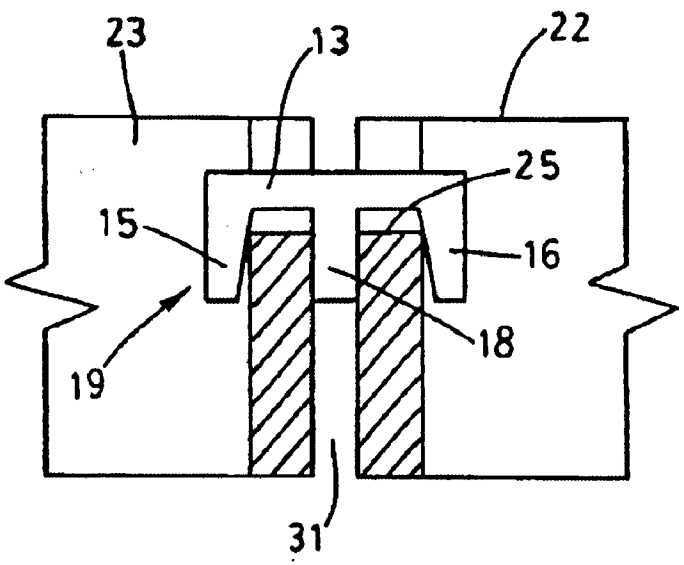
FIG. 7 is a sectional view along line 7—7 of FIG. 6.
Figure 9:
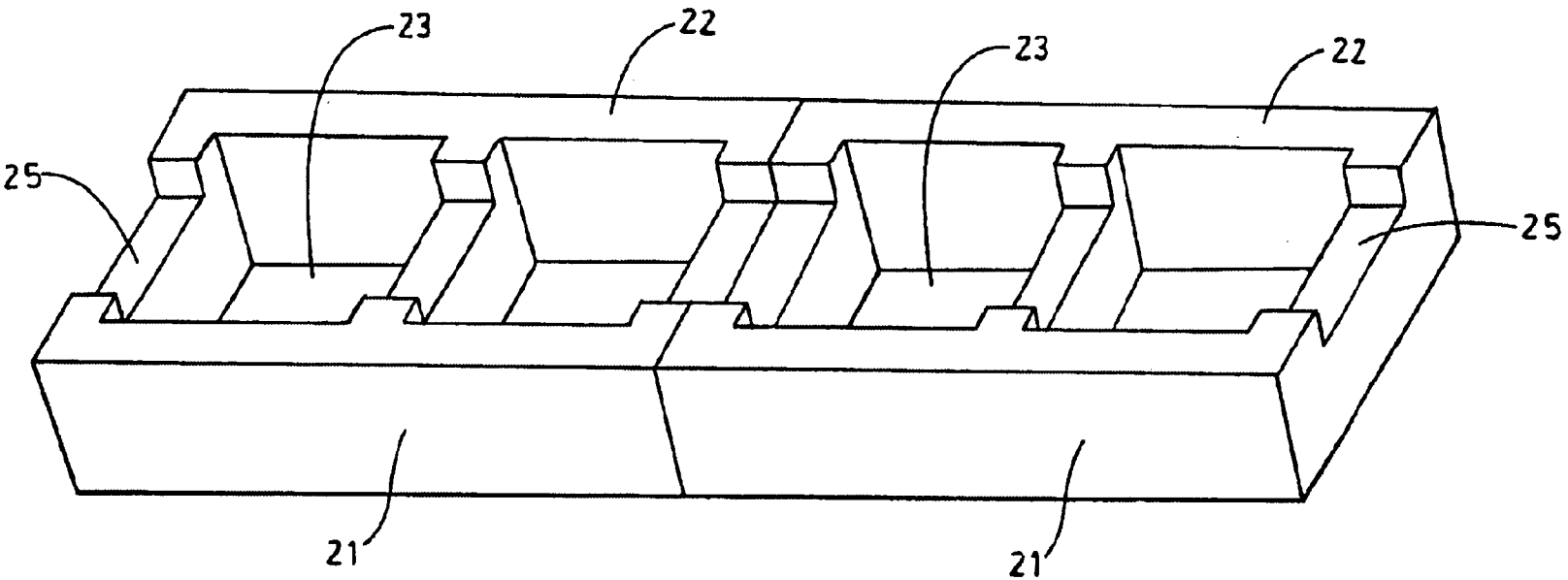
FIG. 9 is a perspective view of a pair of side-by-side open celled masonry blocks.

In the alternative embodiment shown in FIGS. 3, 6 and 7, it is seen that E-shaped bracket 19, like bracket 11, has a generally flat cross section made up of a longitudinal cross member 13 and a pair of integral arms 15, 16 located at each end of cross member 13. As with bracket 11, arms 15 and 16 are generally parallel to each other and generally perpendicular to cross member 13. The outside edges 17 of arms 15 and 16 are at approximately right angles to cross member 13, however the inside edges 14 are slightly tapered such that the outwardly extending distal ends of arms 15 and 16 are more narrow than the proximal ends which are integrally attached to the cross member. This tapering allows for more frictional contact between the inside edges 14 of arms 15 and 16 and the edges of the masonry blocks 21 into which the arms are inserted. An additional arm 18 is provided at the center of bracket 19 between arms 15 and 16. Arm 18 is generally perpendicular to cross member 13 and generally parallel to arms 15 and 16. The width of arm 18 is consistent throughout its length.

Bracket 19 having the additional arm 18 is used to create a space or gap 31 between masonry blocks 21, as illustrated in FIGS. 6 and 7. Each gap 31 defines an angle between the ends of the adjacent blocks 21 so that by providing multiple gaps between courses of adjacent blocks, a curve may be provided in the wall. The width of arm 18 will define the length of the gap 31 between blocks 21, and thereby define the angle between blocks and the degree of curvature in the wall. Thinner arms 18 will result in smaller gaps 31 and less curvature in the wall. Wider arms 18 will result in larger gaps 31 and more curvature in the wall. Arms 18 of different widths can be used in different combinations to create different curved effects in a wall.

In the installation shown in FIG. 6, a C-shaped bracket 11 is inserted across the front of the gap 7—7 between the cells, and an E-shaped bracket 19 is inserted across the back of the gap 7—7. A hammer or other suitable tool is used to force the brackets 11 and 19 into gap 7—7 such that the tapered inside surfaces 14 of arms 15 and 16 are frictionally engaged with the walls below notches 25 of each of the adjacent blocks 21. Brackets 11 hold the fronts of the blocks 21 securely against each other, and brackets 19 securely engage the backs of blocks 21, separating them by a space 31 that is the same as the width of center arm 18. Brackets 11 and 19 are forced a sufficient distance into gaps 7—7 such that the tops of cross members 13 are below the upper surfaces 22 of the blocks in the course. As shown in the cross-sectional view of FIG. 7.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. A bracket for attaching together adjacent blocks of a course, the blocks being of a type having open internal cells with recessed notches at the ends of the cells, the bracket comprising a flat integrated unit having a longitudinal cross member and a pair of arms located at opposite ends of said cross member, said arms extending out from said cross member and being generally parallel to each other and generally perpendicular to said cross member, said arms being designed for insertion into the open cells of adjacent blocks with said cross member extending across a gap defined by the adjacent recessed notches of the adjacent blocks wherein each of said arms has an outside edge that is approximately perpendicular to said cross member, and an inside edge that is tapered such that the outwardly extending distal ends of said arms are more narrow than the proximal ends that are integrally attached to the cross member and wherein an additional arm is provided at the center of said cross member such that said additional arm is inserted between adjacent blocks of said course defining a space between said blocks.

2. In combination, masonry blocks and brackets for attaching adjacent blocks together along a course comprising a plurality of masonry blocks having side and end walls defining an interior and an exterior for each block, each block having at least one open cell defining at least one hollow interior region in said block, each block also having at least one notch at an edge of one of said walls allowing communication between said at least one cell and the exterior of said block; and a plurality of brackets for attaching adjacent blocks together along a course, each bracket comprising a flat integrated unit having a longitudinal cross member and a pair of arms located at opposite ends of said cross member, said arms extending out from said cross member and being generally parallel to each other and generally perpendicular to said cross member, said arms being designed for insertion into the open cells of adjacent blocks such that said cross member extends across a gap defined by the adjacent notches of said adjacent blocks.

3. The combination of claim 2 wherein each of said arms has an outside edge that is approximately perpendicular to said cross member, and an inside edge that is tapered such that the outwardly extending distal ends of said arms are more narrow than the proximal ends that are integrally attached to the cross member.

4. The combination of claim 3 wherein an additional arm is provided at the center of said cross member such that said additional arm is inserted between adjacent blocks of said course defining a space between said blocks.

5. The combination of claim 2 wherein a plurality of said courses are stacked upon each other to form a wall.

6. In combination, masonry blocks and brackets for attaching adjacent blocks together along an arcuate course comprising a plurality of masonry blocks having side and end walls defining an interior and an exterior for each block, each block having at least one open cell defining at least one hollow interior region in said block, each block also having at least one notch at an edge of one of said walls allowing communication between said at least one cell and the exterior of said block; and a plurality of pairs of brackets for attaching adjacent blocks together along a course, each bracket comprising a flat integrated unit having a longitudinal cross member and a pair of arms located at opposite ends of said cross member, said arms extending out from said cross member and being generally parallel to each other and generally perpendicular to said cross member, said arms being designed for insertion into the open cells of adjacent blocks such that said cross member extends across a gap defined by the adjacent notches of said adjacent blocks, wherein each of said arms has an outside edge that is approximately perpendicular to said cross member, and an inside edge that is tapered such that the outwardly extending distal ends of said arms are more narrow than the proximal ends that are integrally attached to the cross member; and wherein one of the brackets of each pair includes an additional arm provided at the center of said cross member such that said additional arm is inserted between adjacent blocks of said course defining a space between said blocks wherein a plurality of said courses are stacked upon each other to form an arcuate wall.

7. A method for attaching together adjacent masonry blocks of a course without using mortar comprising the steps of:

a. placing a pair of masonry blocks next to each other on a course such that they touch, each of said blocks having side and end walls defining an interior and an exterior with each block having at least one open cell defining at least one hollow interior region in said block, and each block also having at least one notch at an edge of one of said walls allowing communication between said at least one cell and the exterior of such block such that the notches of said pair of blocks align and touch each other forming a large notch for communication between said blocks;

b. inserting at least one bracket across said large notch to hold said pair of blocks together, said at least one bracket having a longitudinal cross member and a pair of arms located at opposite ends of said cross member, said arms extending out from said cross member and being generally parallel to each other and generally perpendicular to said cross member, such that said arms fit the open cells of said adjacent blocks.

8. The method of claim 7 comprising the additional steps of:

c. placing another of said masonry blocks next to one of said pair of blocks such that another large notch is formed, and d. inserting at least one of said brackets across said another large notch.

9. The method of claim 8 comprising the additional steps of repeating steps "c" and "d" until a course is completed.

10. The method of claim 9 comprising the additional steps of adding a plurality of additional courses according to step "a" in stacking relationship on top of said first course to create wall.

11. The method of claim 10 comprising the additional step of providing vertical steel rods at different locations along said courses such that the open cells of said blocks fit over said rods to provide vertical stability in said wall.

12. The method of claim 11 comprising the additional step of reinforcing said wall by pouring grout into the hollow interior cells of the blocks of said stacked courses.

13. The method of claim 10 comprising the additional step of reinforcing said wall by pouring grout into the hollow interior cells of the blocks of said stacked courses.

14. A method for eliminating the use of mortar between blocks during the erection of a block wall comprising the steps of:

a. establishing a first course by 1. placing blocks in contiguous side by side relationship, each of said blocks having side and end walls defining an interior and an exterior with each block having at least one open cell defining at least one hollow interior region in said block, and each block also having at least one notch at an edge of one of said walls;
2. connecting said blocks together by inserting at least one bracket across each channel formed by adjoining notches of contiguous blocks, said at least one bracket having a longitudinal cross member and a pair of arms located at opposite ends of said cross member, said arms extending out from said cross member and being generally parallel to each other and generally perpendicular to said cross member, such that said cross member bridges said channel and said arms fit into the open cells of said contiguous blocks; and b. adding a plurality of additional courses according to step "a" in stacking relationship on top of said first course to create wall.

15. The method of claim 14 comprising the additional step of providing vertical steel rods at different locations along said courses such that the open cells of said blocks fit over said rods to provide vertical stability in said wall.

16. The method of claim 14 comprising the additional step of pouring reinforcing grout into the open cells of the blocks of the wall formed by said courses.

17. The method of claim 15 comprising the additional step of pouring reinforcing grout into the open cells of the blocks of the wall formed by said courses.

18. A method for erecting an arcuate wall out of blocks without using mortar between the blocks comprising the steps of:

a. establishing a first course by 1. placing blocks in side by side relationship, each of said blocks having side and end walls defining an interior and an exterior with each block having at least one open cell defining at least one hollow interior region in said block, and each block also having at least one notch at an edge of one of said walls;
2. connecting an edge of each of said blocks together by inserting at least one first bracket across one end of each channel formed by adjoining notches of adjacent blocks, said first bracket having a longitudinal cross member and a pair of arms located at opposite ends of said cross member, said arms extending out from said cross member and being generally parallel to each other and generally perpendicular to said cross member, such that said cross member bridges said channel and said arms fit into the open cells of said adjacent blocks;
3. causing the position of adjacent blocks to be offset by inserting at least one second bracket across an opposite end of each of said channels, said second bracket including all of the features of said first bracket and also including a third centrally located arm that fits between adjacent blocks forming a space therebetween; and b. adding a plurality of additional courses according to step "a" in stacking relationship on top of said first course to create an arcuate wall.

19. The method of claim 18 comprising the additional step of providing vertical steel rods at different locations along said courses such that the open cells of said blocks fit over said rods to provide vertical stability in said wall.

20. The method of claim 18 comprising the additional step of pouring reinforcing grout into the open cells of the blocks of the wall formed by said courses.

21. The method of claim 19 comprising the additional step of pouring reinforcing grout into the open cells of the blocks of the wall formed by said courses.

22. A method for erecting a wall out of blocks without using mortar between the blocks comprising the steps of:

a. establishing a first course by 1. placing blocks in side by side relationship, each of said blocks having side and end walls defining an interior and an exterior with each block having at least one open cell defining at least one hollow interior region in said block, and each block also having at least one notch at an edge of one of said walls;
2. connecting an edge of each of said blocks together by inserting at least one bracket across one end of each channel formed by adjoining notches of adjacent blocks, said bracket having a longitudinal cross member and a pair of arms located at opposite ends of said cross member and a third centrally located arm, said arms extending out from said cross member and being generally parallel to each other and generally perpendicular to said cross member, such that said cross member bridges said channel such that said end arms fit into the open cells of said adjacent blocks and said central arm fits into a gap formed between said blocks;

b. adding a plurality of additional courses according to step "a" in stacking relationship on top of said first course to create a wall.

23. The method of claim 22 comprising the additional step of providing vertical steel rods at different locations along said courses such that the open cells of said blocks fit over said rods to provide vertical stability in said wall.

24. The method of claim 22 comprising the additional step of pouring reinforcing grout into the open cells of the blocks of the wall formed by said courses.

25. The method of claim 23 comprising the additional step of pouring reinforcing grout into the open cells of the blocks of the wall formed by said courses.

* * * * *